US012392161B1

(12) United States Patent
Fishpaw

(10) Patent No.: US 12,392,161 B1
(45) Date of Patent: Aug. 19, 2025

(54) FENCE POST COVERS

(71) Applicant: James A Fishpaw, Keller, TX (US)

(72) Inventor: James A Fishpaw, Keller, TX (US)

( * ) Notice: Subject to any disclaimer, the term of this patent is extended or adjusted under 35 U.S.C. 154(b) by 0 days.

(21) Appl. No.: 19/074,128

(22) Filed: Mar. 7, 2025

Related U.S. Application Data

(60) Provisional application No. 63/568,389, filed on Mar. 21, 2024.

(51) Int. Cl.
*E04H 17/00* (2006.01)

(52) U.S. Cl.
CPC ..... *E04H 17/006* (2021.01)

(58) Field of Classification Search
CPC ..... E04H 17/006
See application file for complete search history.

(56) References Cited

U.S. PATENT DOCUMENTS 822,814 A * 6/1906 Baker ..... E04H 17/006 256/52
1,728,576 A * 9/1929 Schem ..... A63K 1/02 472/87
3,173,662 A * 3/1965 Millerbernd ..... E04H 17/12 256/52
3,714,750 A * 2/1973 Pallotto ..... E04F 13/0837 52/220.1
4,369,953 A * 1/1983 Greiner ..... E04H 17/143 256/73
4,516,756 A * 5/1985 Beatty ..... E04H 17/006 256/19
4,540,160 A * 9/1985 Zanavich ..... E04H 17/1413 256/66
4,958,807 A * 9/1990 Wylie ..... E04F 11/181 403/191
4,991,823 A * 2/1991 Stanish, Jr. ..... E04H 17/006 256/65.01
5,547,169 A * 8/1996 Russell ..... E04H 17/1439 256/65.05

(Continued)

FOREIGN PATENT DOCUMENTS

FR 2343877 A1 * 3/1976

OTHER PUBLICATIONS

The Garden Glove, fence post covers appearing at website <https://www.thegardenglove.com/got-ugly-metal-fence-posts-diy-garden-project-cure>, screenshot dated Mar. 25, 2025.

(Continued)

*Primary Examiner* — Joshua K Ihezie

(57) ABSTRACT

Fence post covers for toolless mounting on vertical fence posts to enhance the overall aesthetic appearance of fences. Fence post covers have one or more lateral walls having a rearward side forming a channel, and a top wall having an indentation formed on a bottom side thereof for mating with a top side of a vertical fence post. One or more flexible brackets are positioned within the channel, the brackets featuring vertically oriented apertures having rearward facing openings for receiving a section of a vertical fence post. Other embodiments of fence post covers feature an elongate hollow body having a lateral wall enclosure forming a lumen with a central cavity having one or more slits formed along opposing sides of at least a portion of a length of the lateral wall, the slits configured to receive one or more strands of barbed wire attached to a T-post.

12 Claims, 7 Drawing Sheets

(56) References Cited

U.S. PATENT DOCUMENTS 5,622,356 A * 4/1997 Duggan ..... E04H 12/2292 52/170
5,704,188 A * 1/1998 Coulis ..... E04C 3/36 248/156
5,927,694 A * 7/1999 Montepiano ..... E04H 17/143 256/22
6,385,938 B1 * 5/2002 Gavin ..... E04C 5/203 52/678
6,935,623 B2 * 8/2005 Cook ..... E04H 17/143 256/65.08
6,945,517 B2 * 9/2005 Augur ..... E04H 17/00 256/19
7,104,525 B2 * 9/2006 Ricci ..... E04H 12/2292 47/32.4
7,357,738 B2 * 4/2008 White ..... A63B 71/023 473/481
7,850,148 B2 * 12/2010 Collins, IV ..... E04H 17/21 248/156
9,752,291 B2 * 9/2017 Michael ..... E01F 15/141
10,563,405 B2 * 2/2020 Johnson, III ..... E04C 5/168
11,124,934 B2 * 9/2021 Beason ..... E01F 9/685
12,077,979 B1 * 9/2024 Vali ..... E04H 17/1447
12,077,981 B2 * 9/2024 Amsellem ..... E04H 17/16
2004/0075089 A1 * 4/2004 Augur ..... E04H 17/00 256/1
2006/0027796 A1 * 2/2006 O'Connor ..... E04H 12/20 256/1
2007/0085065 A1 4/2007 Ramos
2008/0217598 A1 * 9/2008 Dombroski ..... E04H 17/185 256/24
2015/0187236 A1 * 7/2015 Beckley ..... G09F 7/18 40/607.03
2020/0069047 A1 * 3/2020 Brennan ..... A47B 13/003
2023/0175285 A1 * 6/2023 Chenal ..... E04H 17/12 52/834

OTHER PUBLICATIONS

Hoover Fence Co., fence post covers appearing at website <https://www.pinterest.com/pin/99642210482699906/>, screenshot dated Mar. 8, 2024.

Emperor Shield, fence post covers appearing at website <http://www.emperorshield.eu/en/emperor-shield-pallet-rack-protector>, screenshot dated Mar. 25, 2025.

* cited by examiner

FENCE POST COVERS

CROSS-REFERENCE TO RELATED APPLICATION

This application claims priority to U.S. Provisional Patent Application No. 63/568,389, filed on Mar. 21, 2024, titled "Fence Post Cover Assemblies," the complete disclosure of which is incorporated herein by reference in its entirety.

BACKGROUND OF THE INVENTION

Technical Field

The present invention relates generally to fences and more particularly, to fence post covers having a novel housing configuration and other unique aspects for concealing fence posts so as to improve the overall aesthetic appearance of a fence, and further utilizing one or more flexible mounting brackets to facilitate the convenient and toolless mounting and removal of such cover onto and off of fence posts.

Description of Related Art

The utilization of fencing in both residential and commercial settings has become widespread in recent decades. Fencing, regardless of the setting, provides many notable advantages—namely, fencing is typically used to enclose an area of ground to mark a boundary, control access, or prevent escape. Depending on the type of fencing utilized, it can also provide an element of privacy by preventing those on the outside of the fencing from viewing what is enclosed by the fencing. A popular type of fencing often used in residential settings is referred to as "privacy fence," which typically consists of multiple vertical wood planks aligned side-by-side (or overlapping in some fences) and connected via multiple horizontally oriented wood rails. Multiple vertical posts, typically made of galvanized steel, are attached to vertical planks at regular intervals and embedded within the ground to provide the fence with enhanced structural support. The side of the privacy fence in which the vertical posts and associated mounting hardware are used to mount the posts to the vertical planks is by many considered to be less than aesthetically pleasing. In fact, many consider the side of the fence in which the vertical posts are visible to be the unattractive side of the fence due to the visibility of unsightly metal hardware used to fasten the fence posts to horizontal rails of the fence.

Therefore, what is needed is a fence post cover that effectively conceals unsightly vertical fence posts in a manner that enhances the overall visual aesthetics of a fence. What is also needed is a fence post cover that is capable of easily being installed and removed by a non-professional without the use of tools. What is also needed is a fence post cover that can be securely mounted to a vertical fence post such that it will not be easily dislodged due to wind or relatively minor contact made by people, pets, lawn equipment, or other machinery. What is also needed is a fence post cover that securely grasps and retains the vertical fence post to which it is mounted in such a way that wind-induced vibrations do not result in unwanted noise. These and other needs are met by the embodiments of the fence post covers described below with reference to the accompanying drawings.

BRIEF DESCRIPTION OF THE SEVERAL VIEWS OF THE DRAWINGS

The claimed invention(s) will be more fully understood by reference to the following detailed description of the preferred and alternate embodiments when read in conjunction with the accompanying drawings, wherein:

Figure 1:
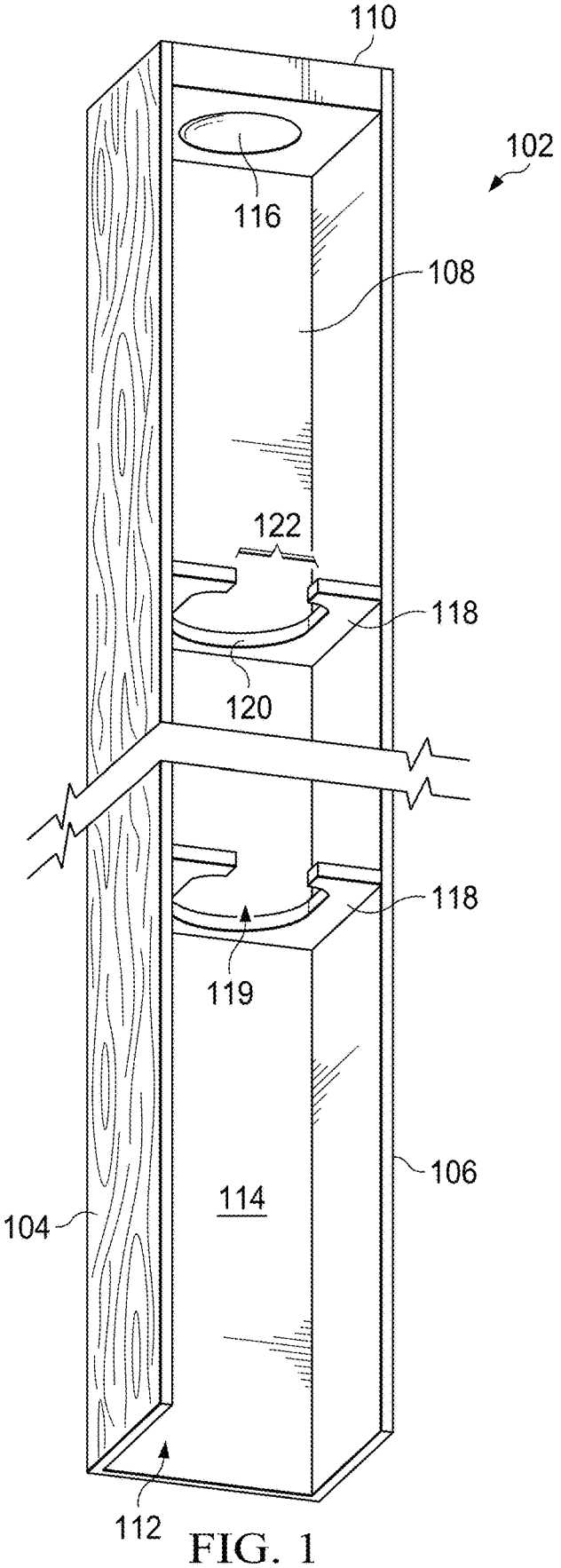
FIG. 1 is a perspective view of an embodiment of a fence post cover according to the present invention.

The above figures are provided for the purpose of illustration and description only, and are not intended to define the limits of the disclosed invention. Furthermore, if and when the terms "top," "bottom," "under," "first," "second," "upper," "lower," "height," "width," "length," "end," "side," "horizontal," "vertical," and similar terms are used herein, it should be understood that these terms have reference only to the structure shown in the drawing and are utilized only to facilitate describing the particular embodiment. The extension of the figures with respect to number, position, relationship, and dimensions of the parts to form the preferred embodiment will be explained or will be within the skill of the art after the following teachings of the present invention have been read and understood.

DETAILED DESCRIPTION OF EMBODIMENTS OF THE INVENTION

Several exemplary embodiments of the claimed invention(s) will now be described with reference to the drawings. Unless otherwise noted, like elements will be identified by identical or corresponding numbers throughout all figures. The invention(s) illustratively disclosed herein suitably may be practiced in the absence of any element that is not specifically disclosed herein. The following description is not to be taken in a limiting sense, but is made merely for the purpose of describing the general principles of exemplary embodiments. The scope of the invention(s) should be determined with reference to the claims. Reference throughout this specification to "one embodiment," "an embodiment," or similar language means that a particular feature, structure, or characteristic described in connection with the embodiment is included in at least one embodiment of the inventions disclosed herein. Thus, appearances of the phrases "in one embodiment," "in an embodiment," and similar language throughout this specification may, but do not necessarily, all refer to the same embodiment except where otherwise noted. Furthermore, the described features, structures, or characteristics of the invention may be combined in any suitable manner in one or more embodiments. In the following description, numerous specific details are provided, such as examples of structures, methods of use of the devices, etc., to provide a thorough understanding of embodiments of the invention(s). One skilled in the relevant art will recognize, however, that the invention(s) can be practiced without one or more of the specific details, or with other methods, components, materials, and so forth. In other instances, well-known structures, materials, or operations are not shown or described in detail to avoid obscuring aspects of the invention(s).

Disclosed herein are embodiments of fence post covers configured to be mounted on vertical fence posts to enhance the overall visual aesthetic appearance of fences by concealing the unsightly fence posts to which they are mounted. It should be noted that while the exemplary embodiments of the fence post covers described herein are configured for mounting upon and for usage in conjunction with vertical metal posts typically used in connection with wood and barbed wire fences, the invention(s) are also contemplated for use, in alternate embodiments, in conjunction with other types of fences made of various materials and, with relatively minimal modifications, could also be utilized in connection with certain types of horizontally oriented rail/post structures. All dimensions described herein, if any, and proportions depicted in the drawings of this disclosure, should be considered merely exemplary and non-limiting. The teachings herein may be equally applied to fence post covers having various dimensions and proportions for mounting on fence posts, all having various sizes and proportions.

Referring now to FIG. 1, shown is a perspective view of an embodiment of a fence post cover (102) according to the present invention. In one embodiment, the fence post cover (102) comprises an elongate body having a front wall (108) (only a rear inner side of the front wall is depicted in FIG. 1), a first lateral wall (104), a second lateral wall (106) (only an inner side of the second lateral wall is depicted in FIG. 1), and a top wall (110). In one embodiment, the first and second lateral walls have front edges (not shown) attached to respective lateral side edges of the front wall such that said lateral walls are oriented with respect to the front wall at approximately right angles. However, it is contemplated that alternate embodiments of the fence post covers may be configured to have an elongate body having different numbers of sides including, but not limited to, a unitary wall without discrete sides attached to one another (in other words, a single wall structure that, when mounted to a fence post, wraps around the visual portions of the fence post facing away from the fence). The reader should note that the term "front" as used herein in connection with structures such as, for example, "front wall," is intended to refer to a direction away from the fence to which the fence post cover is mounted. Conversely, the terms "rear" and "rearward" as used herein in connection with structures of the fence post cover is intended to refer to a direction towards a fence to which the fence post cover is mounted. Other terms such as "top," "bottom," "upper," and "lower" refer to orientations of the fence post covers when vertically mounted on a vertical fence post (for example, the terms "bottom" and "lower" refer to positions closer to the ground when the fence post cover is vertically mounted to a vertical fence post cover).

Still referring to FIG. 1, in one embodiment, the top wall (110) is attached to respective top edges of the front wall (108), the first lateral wall (104), and the second later wall (106). In one embodiment, an indentation (116) is formed on a bottom side of the front wall, the shape and size of the indentation (116) being selected to mate with at least a portion of a correspondingly shaped and sized top end or cap of a vertical fence post to which the fence post cover will be mounted. The indentation (116), when mated with at least a portion of the top end of a fence post, works to more firmly secure the fence post cover to the fence post to which it is mounted, reducing the likelihood of the fence post cover from being inadvertently dislodged due to various forces applied to the fence post cover and/or the fence itself (for example, wind, contact by other persons, animals, lawn equipment, vehicles, etc.). The indentation (116), when mated with at least a portion of the top end of a fence post, also works to reduce unwanted noises that might otherwise result from vibrations caused by wind blowing on the fence post cover. In some embodiments, the indentation may be completely or partially lined with a cushioning material or noise-deadening material (for example, foam, felt, or rubber) and/or magnetic material to reduce unwanted noise and to better secure the top of a post within said indentation. It should be noted that although the top side of the top wall (110) depicted herein is substantially flat, in other embodiments the top side of the top wall may be angled to allow for more efficient runoff of water and snow (to keep such precipitation from pooling on the top side of the top wall). In other embodiments, the top side of the top wall and/or the outer surfaces of the lateral and front walls, may be configured to have decorative surfaces rather than the flat surfaces as depicted herein.

Still referring to FIG. 1, a channel (114) is formed on the rear side of the elongate body with the respective inner sides of said front wall, said first lateral wall, and said second lateral wall forming the lateral channel walls (inner side of lateral walls) and bottom channel wall (inner side of front wall) of the channel. In one embodiment, the channel has a closed upper end (closed by the top wall (110)) and an open lower end (112) with no structures obstructing the lower end of the channel. In one embodiment, one or more flexible brackets (118) are attached to the inner sides of the front wall, the first lateral wall, and the second lateral wall within the channel. Each of the one or more flexible brackets (118) has a vertically oriented aperture (122) having a rearward facing opening (122) configured to expand or otherwise deform. As used herein, the term "vertically oriented aperture" refers to an aperture positioned such that a vertically oriented structure like a vertical fence post may pass through it. In one embodiment, at least portions of the outer surface of a vertical fence post on which the fence post cover is mounted will at least intermittently contact a lateral edge (120) of the vertically oriented aperture, which aids in securing the fence post cover to the vertical fence post. As described in more detail below, the flexible brackets are constructed of a flexible or otherwise deformable material (for example, a polymer such as polypropylene or polyethylene) that allow the bracket or at least a rear portion of the bracket adjacent to the rearward facing opening (122) to deform enough with only minor application of force by a user to enable a segment of a vertical fence post to pass through the rearward facing opening (122) and into the vertically oriented aperture (122). The rearward facing opening of each of said one or more flexible brackets is naturally biased to converge to grasp and retain said vertical fence post. In alternate embodiments, the flexible nature of the brackets may be accomplished by utilizing other means for allowing the rearward facing opening to expand and contract (or otherwise deform) to allow for a vertical fence post to pass through the opening and into the aperture (for example, rollers on spring-mounted arms of the bracket may be mounted adjacent to the opening in alternate embodiments). The flexible nature of the brackets provides an advantage over prior art fence post covers in that the flexible brackets allow for the toolless mounting and removal of the fence post cover onto and off of a vertical fence post. As depicted herein, multiple flexible brackets may be used in conjunction with the fence post cover, the number of brackets utilized depending on factors such as the length of the elongate body of the fence post cover, and the degree to which the user/maker seeks to secure the fence post cover to a fence post. Typically, the length of the fence post cover will be selected based on the height/length of the vertical fence post to which it will be mounted. In some embodiments, a length of the elongate body will be selected to approximate the length of fence post as measured from just above the ground to the top of the fence post. However, in other embodiments, it is contemplated that it may be desirable to select a length of the elongate body of the fence post cover that provides a substantial gap between the ground and the bottom of the elongate body (for example, to avoid inadvertent contact of the fence post cover by lawn care equipment and other machinery such as lawn mowers, trimmers, and snow blowers). Such a configuration may also assist in maintaining the cleanliness of the bottom portion of the fence post cover. To the extent that a length of an elongate body of a fence post cover is relatively short, it may be necessary to utilize only a single flexible bracket to sufficiently secure the fence post cover to the fence post. In other more common configurations, two, three, four, or more flexible brackets may be utilized to sufficiently secure the fence post cover to the fence post.

Still referring to FIG. 1, it is contemplated that the elongate body of the fence post cover may be constructed of any number of materials including, but not limited to, polymers, metals, metal alloys, wood, carbon fiber, or combinations of the foregoing materials. In some embodiments, the outer surfaces of the fence post covers or portions thereof may have decorative elements applied during or after the manufacturing process such as, for example, wood grain laminates. In other embodiments, depending on the type of material used to construct the elongate body of the fence post covers, paints, protective sealants, and other protective and/or decorative substances may be embedded or applied to enhance the sustainability of the fence post covers and also to enhance the visual aesthetics of the cover and fence.

Figure 2:
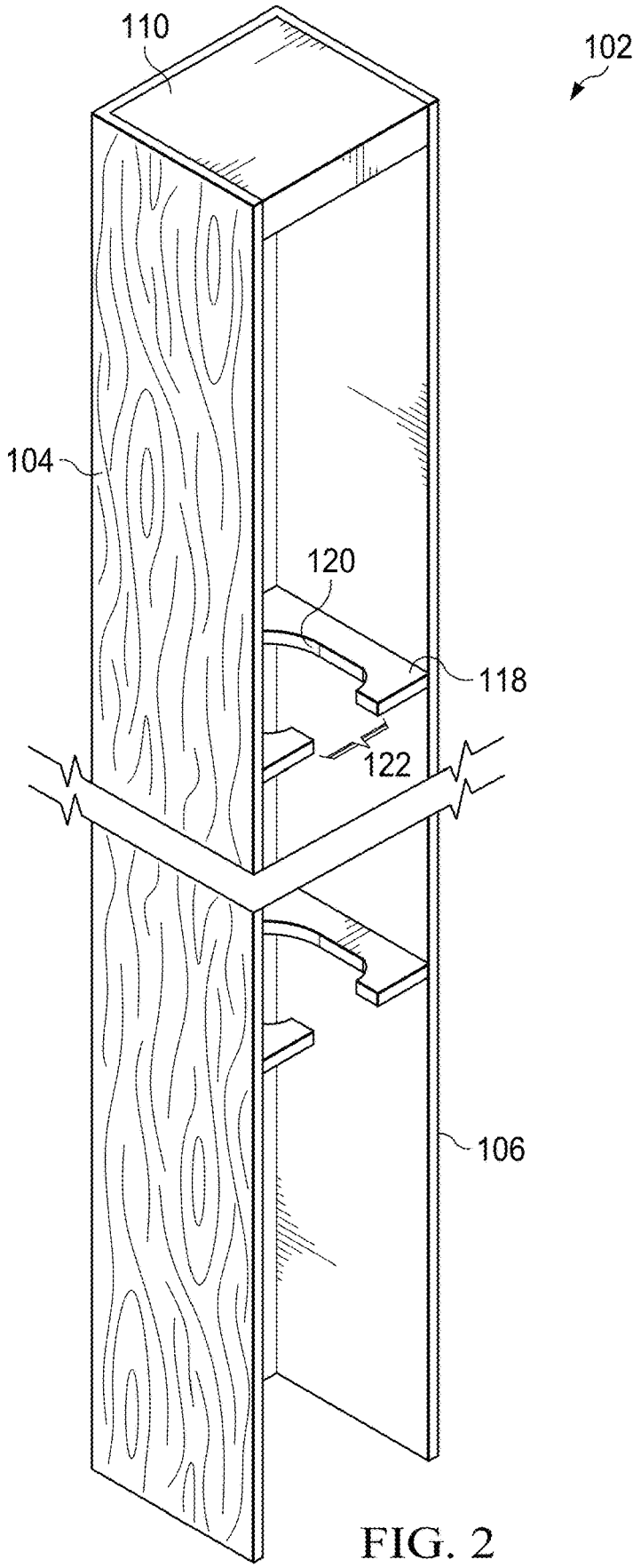
FIG. 2 is a further perspective view of the embodiment of the fence post cover depicted in FIG. 1.

Referring now to FIG. 2, shown is a further perspective view of the embodiment of the fence post cover (102) depicted in FIG. 1. As noted above, although the top side of the top wall (110) depicted herein is substantially flat, in other embodiments the top side of the top wall may be angled to allow for efficient runoff of water and snow (to keep such precipitation from pooling on the top side of the top wall). In some embodiments, one or more drain holes may be formed through the top wall to allow for better water drainage. In even other embodiments, the top side of the top wall and/or the outer surfaces of the lateral and front walls, may be configured to have textured decorative surfaces rather than the flat surfaces depicted herein. Further, with reference to the lateral edges (120) of the vertically oriented apertures of the flexible brackets (118), it should also be noted that the lateral edges forming the walls of the aperture are generally circular in shape other than at the rearward opening (122). However, in alternate embodiments, the lateral edges of the aperture may be formed in alternative shapes depending on the cross-sectional shape of the section of vertical fence post on which the fence post cover will be mounted. Likewise, the width of the rearward opening of the aperture may vary depending on factors such as the thickness of the vertical fence post and the deformability of the materials used to construct the flexible bracket. In some embodiments, the portion of the brackets adjacent to the rearward opening (122) may be rounded to permit for easier passage of the fence post into the aperture. In some embodiments, a cushioning material or some other noise-deadening material (for example, foam, felt, or rubber) may be attached to at least portions of the lateral edges (120) to better secure the fence post within the aperture, and to reduce unwanted noise that might otherwise result from wind-induced vibrations on the fence post cover. In other embodiments, one or more magnets may be attached to at least portions of the lateral edges (120) to better secure the fence post within the aperture.

Figure 3:
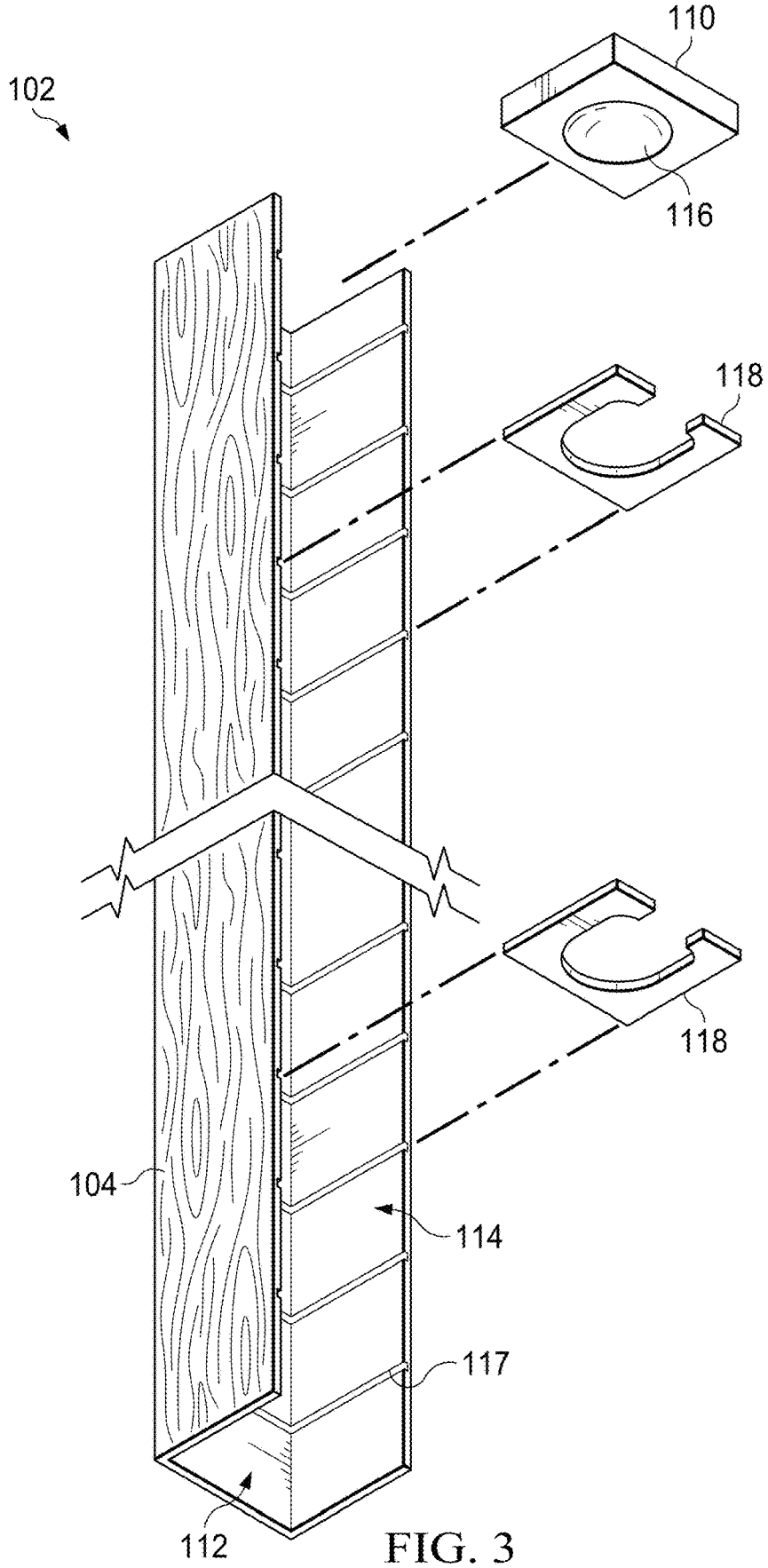
FIG. 3 is a partially exploded view of an alternate embodiment of the fence post cover.

Referring now to FIG. 3, shown is a partially exploded view of an alternate embodiment of the fence post cover. In one embodiment, the one or more flexible brackets (118) may be removably attached to the elongate body. In such embodiments, one or a plurality of slots (117) may be formed in the channel on the inner sides of the lateral walls and/or front wall along the length of the channel, said slot(s) being sized and shaped to receive flexible brackets configured to slide into such respective slot(s), which will permit a user to position the brackets within the channel at positions that allow for easier mounting of the fence post cover onto a fence post. As explained below with reference to FIG. 5, the flexible brackets are ideally positioned within the channel at heights that do not correspond to the location of fastening brackets configured to attach a vertical fence post to horizontal rails. By allowing for user-selected positioning of removably attached flexible brackets within the channel of the fence post cover, the invention described herein provides a further advantage over prior art fence post covers in that a user can customize the fence post cover to better conform to the actual configuration of the actual fence post to which it will be mounted.

Still referring to FIG. 3, the top wall (110) having an indentation (116) formed on a bottom side thereof may have a vertical thickness that is selected during manufacturing depending on a number of factors. One factor that should be considered in selecting the vertical thickness of the top wall is the desired depth of the indentation formed on the bottom side of the top wall. Those of skill in the art will recognize that a thicker vertical thickness of the top wall will allow for a deeper indentation to be formed on the bottom side of the top wall, which will in turn result in a greater ability of the indentation to hold in place the top end or cap of a vertical fence post. It should be noted that the thickness of the other walls (front wall and lateral walls) forming the elongate body of the fence post cover may also be selected based on a number of factors including, but not limited to, the desired weight of the overall fence post cover, the type(s) of materials used to construct the walls, and the means by which the walls are attached to one another. In some embodiments in which the walls are attached by adhesives and/or various types of fasteners (right angle brackets, screws, nails, etc.), the thickness of the walls may be greater than in other types of embodiments of the fence post cover such as a unitary polymer not having discrete walls attached to one another.

Figure 4:
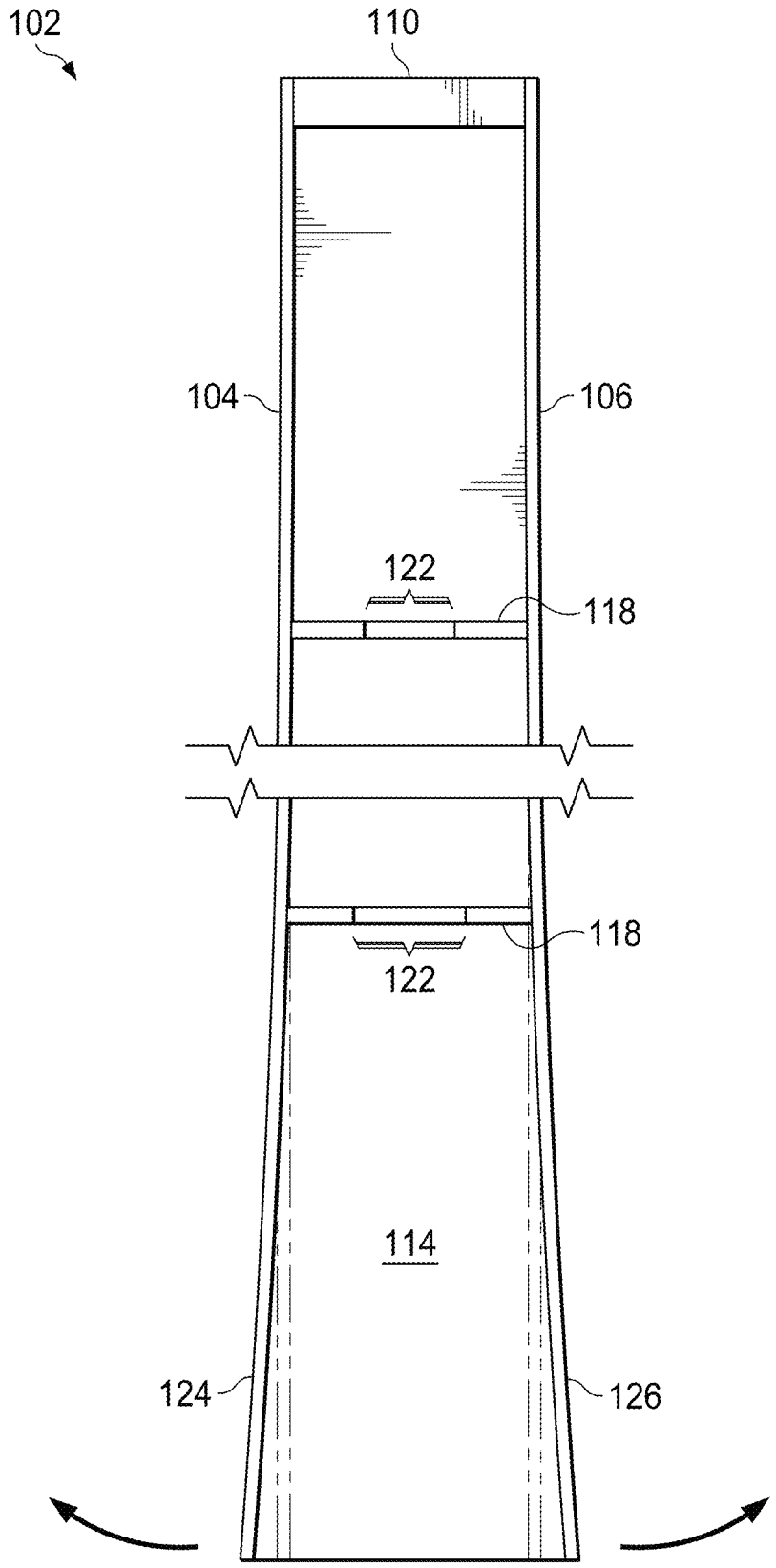
FIG. 4 is a further perspective view of the embodiment of the fence post cover depicted in FIG. 1, illustrating the flexible properties of the first and second lateral walls of said cover.

Referring now to FIG. 4, shown is a further perspective view of the embodiment of the fence post cover (102) depicted in FIG. 1, illustrating the flexible properties of the first and second lateral walls of said cover. In one embodiment, the first lateral wall (104) and the second lateral wall (106) have bottom portions (124, 126) configured to flex outwardly away from the channel (114). In such an embodiment, the flexible nature of the bottom portions of the lateral walls may facilitate the ease of mounting and removal of the fence post cover onto and off of a vertical fence post. It is contemplated that in some alternate embodiments, a substantial length of the elongate body, at least past the highest mounted flexible bracket, may have lateral walls capable of outwardly flexing.

Figure 5:
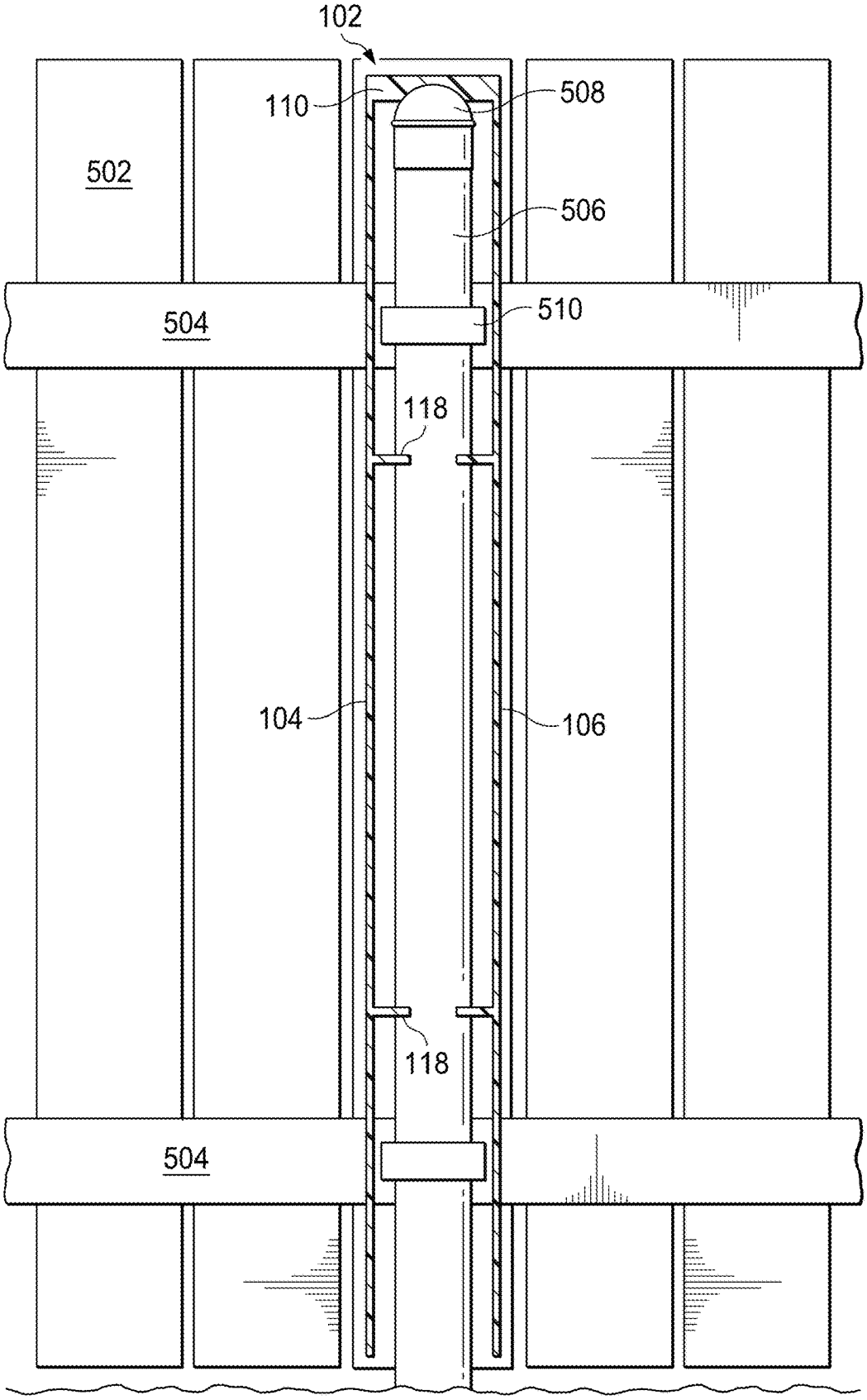
FIG. 5 is a further perspective view of the embodiment of the fence post cover depicted in FIG. 1, said cover mounted to a vertical post of a fence.

Referring now to FIG. 5, shown is a further perspective view of the embodiment of the fence post cover (102) depicted in FIG. 1, said cover mounted to a vertical post (506) of a fence. As depicted, a wood fence utilizing for example, multiple vertical fence posts (506) made of galvanized steel, provides structural support for the fence. The fence post has a bottom end (not shown) typically embedded within a concrete footing, and a top end often having a cap (508) with a hemi-spherical/convex shape. In one embodiment, the top end of the fence post, when a fence post cover is mounted thereon, mates with an indentation on the bottom side of the top wall having a substantially concave shape. In one embodiment, the one or more flexible brackets are positioned along the length of the channel at positions such that the respective brackets will not to come into contact with the fastening brackets (510) used to secure the fence post to the one or more horizontally oriented rails (504) and/or vertically oriented planks (502). A plurality of vertically oriented planks (502) are likewise attached to the one or more rails. It should be noted that although the fence depicted in FIG. 5 is a "stockade" type wood fence, the embodiments of the fence post covers described above may be utilized with various other types of fences that utilize one or more vertical fence posts.

Generally disclosed herein in various embodiments are fence post covers comprising an elongate body having a front wall, a first lateral wall, a second lateral wall, and a top wall, said first lateral wall and said second lateral wall each having front edges attached to side edges of said front wall, said top wall attached to respective top edges of said front wall, first lateral wall, and said second later wall; a channel formed by respective inner sides of said front wall, said first lateral wall, and said second lateral wall, said channel having a closed upper end and an open lower end; and one or more flexible brackets attached to said inner sides of said front wall, said first lateral wall, and said second lateral wall within said channel, each of said one or more flexible brackets having a vertically oriented aperture having rearward facing opening. Further disclosed herein are embodiments of fence post covers wherein said rearward facing opening of each of said one or more flexible brackets is capable of expanding or otherwise deforming to accept a segment of a vertical fence post, said rearward facing opening of each of said one or more flexible brackets being naturally biased to converge to retain said vertical fence post. Further disclosed herein are embodiments of fence post covers wherein an indentation is formed on a bottom side of said top wall. Further disclosed herein are embodiments of fence post covers wherein the indentation is shaped to mate with a correspondingly shaped top end of a vertical fence post. Further disclosed herein are embodiments of fence post covers wherein said one or more flexible brackets are removably attached to said body. Further disclosed herein are embodiments of fence post covers comprising an elongate body having one or more lateral walls forming a channel on a rear side of said elongate body, said channel having a closed upper end and an open lower end; a top wall attached to an upper end of said one or more lateral walls; and one or more flexible brackets attached to one or more inner sides of said one or more lateral walls within said channel, each of said one or more flexible brackets having a vertically oriented aperture having rearward facing opening. Further disclosed herein are embodiments of fence post covers wherein said first lateral wall and said second lateral wall have bottom portions configured to flex outwardly away from said channel.

Figure 6:
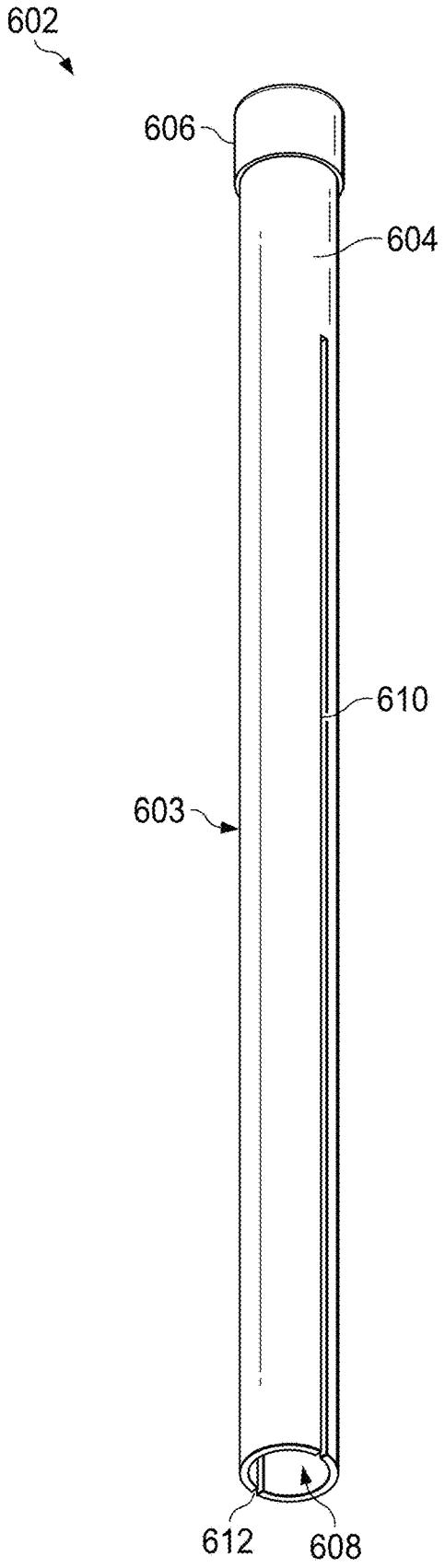
FIG. 6 is a perspective view of an alternate embodiment of a fence post cover according to the present invention.

Referring now to FIG. 6, shown is a perspective view of an alternate embodiment of a fence post cover according to the present invention. In one embodiment, a fence post cover comprises an elongate hollow body (603) having a lateral wall (604) enclosure forming a lumen with a central cavity (608) running along at least a portion of the length of the lumen, the elongate hollow body having an enclosed top end and an open bottom end. In one embodiment, a first slit (610) is formed on a first side of said lateral wall of said elongate hollow body, and a second slit (612) is formed on a second side of the lateral wall of the elongate hollow body, the second slit being formed on the second side of said lateral wall of the elongate hollow body opposite to the first slit, wherein the first slit and the second slit each have respective lengths greater than one half of an overall length of the elongate hollow body. In one embodiment, a removable or non-removable cap (606) is attached to the top end of the elongate hollow body. In one embodiment, the first slit and the second slit each have a slit opening having a thickness enabling it to receive and a correspondingly sized portion of barbed wire (see FIG. 7).

Still referring to FIG. 6, it should be noted that in some embodiments, the central cavity (608) may extend from the bottom end of the elongate body and terminate before reaching the top end of the body. In other words, in some embodiments, only a portion of the length of the elongate hollow body (603) is hollow. Further, although the slits (610, 612) depicted in the embodiment shown at FIG. 6 are positioned on opposite sides of the elongate body, in other alternate embodiments one or more slits may be positioned at alternate locations on the lateral wall, depending on how the particular fence post will be utilized and how the accompanying barbed wires are oriented (for example, a fence post cover for use in conjunction with a corner fence post may have slits formed on the lateral wall of the fence post cover oriented at ninety degrees relative to each other). Moreover, just as with the embodiments of the fence post covers described above with reference to FIGS. 1-5, the outer surfaces of the alternate embodiments of the fence post cover depicted at FIGS. 6 and 7 may be sized, shaped, and textured in various ways without departing from the spirit of the inventions taught herein.

Figure 7:
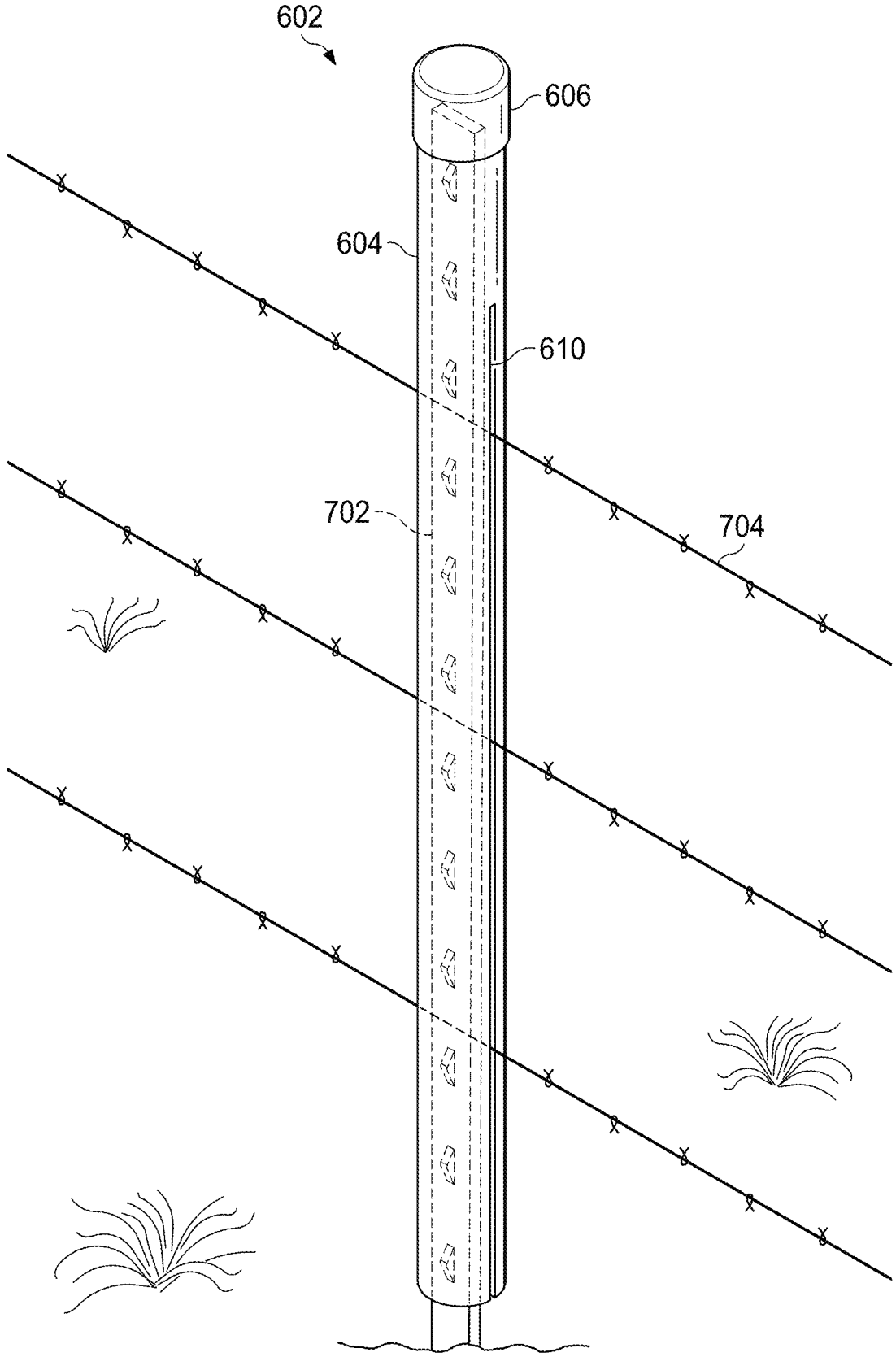
FIG. 7 is a further perspective view of the embodiment of the fence post cover depicted in FIG. 6, said cover mounted to a vertical T-post of a barbed wire fence.

Referring now to FIG. 7, shown is a further perspective view of the embodiment of the fence post cover depicted in FIG. 6, said cover mounted to a vertical T-post of a barbed wire fence. In one embodiment, the bottom side of the fence post cover may be placed over the top end of the T-post such that the T-post slides through the central cavity of the fence post cover until the bottom side of the fence post cover contacts the ground or the top of the T-post abuts the closed top end of the elongate hollow body of the fence post cover. Just as explained above in connection with other embodiments of the fence post covers, the length of the elongate body may be selected based on factors such as the length of the T-post, the number of strands of barbed wire being utilized for the fence, and the height of any desired gap between the ground and the bottom end of the fence post cover. The slits (610, 612) are sized and shaped to receive one or more strands of barbed wire as the fence post cover slides down the T-post. The fence post cover thereby not only acts to conceal the unsightly T-post, but also provides a protective barrier around the T-post to reduce the harmfulness of any inadvertent contact or collisions into the T-posts. For example, the fence post cover serves to enhance the safety of persons that may come into contact with the fence post cover(s) including, but not limited to, persons engaged in hiking, horseback riding, and powersports activities (riding in all terrain vehicles, side-by-sides, and snowmobiles). In one embodiment, the fence post cover may have an outer surface capable of having various colored substances applied for various advantageous purposes. For example, one embodiment of the fence post cover may have a purple colored substance (for example, paint), applied to the outer surface to serve notice to potential trespassers that the property on the other side of the fence is posted (other colors may be used depending on the laws for marking posted property in the particular jurisdiction where the fence is located). In other embodiments, the fence post cover may have a high visibility colored substance (for example, fluorescent orange or yellow paint), applied to the outer surface to enhance the visibility of the fence to people on foot and in vehicles (for example, people riding in all-terrain vehicles or snowmobiles).

The inventions may be embodied in other specific forms without departing from the spirit or essential characteristics thereof. The present embodiments are therefore to be considered in all respects as illustrative and not restrictive. Accordingly, the scope of the inventions is established by the appended claims rather than by the foregoing description. All changes that come within the meaning and range of equivalency of the claims are embraced therein.

I claim:

1. A fence post cover for toolless mounting to a fence post, the fence post cover comprising:

an elongate body having a front wall, a first lateral wall, a second lateral wall, and a top wall, said first lateral wall and said second lateral wall each having front edges attached to respective opposing side edges of said front wall, said top wall attached to respective top edges of said front wall, first lateral wall, and said second later wall;

a channel formed by respective rearward facing inner sides of said front wall, said first lateral wall, and said second lateral wall, said channel having a closed upper end and an open lower end; and one or more flexible brackets attached to said inner sides of said first lateral wall and said second lateral wall, each of said one or more flexible brackets having a vertically oriented aperture and also having a rearward facing opening, wherein said rearward facing opening of each of said one or more flexible brackets is capable of expanding or deforming to accept and be secured to a segment of a vertical fence post without the use of tools, said rearward facing opening of each of said one or more flexible brackets being naturally biased to converge to retain said vertical fence post.

2. The fence post cover of claim 1 wherein an indentation is formed on a bottom side of said top wall.

3. The fence post cover of claim 2 wherein said indentation is shaped to mate with a correspondingly shaped top end of a vertical fence post.

4. The fence post cover of claim 1 wherein said one or more flexible brackets are removably attached to said elongate body.

5. The fence post cover of claim 1 wherein said first lateral wall and said second lateral wall have bottom portions configured to flex outwardly away from said channel.

6. The fence post cover of claim 1, further comprising a plurality of slots formed within said channel, each of said plurality of slots being sized and shaped to receive one of said one or more flexible brackets.

7. A fence post cover for toolless mounting to a fence post, the fence post cover comprising:

an elongate body having at least one lateral wall forming a channel on a rear side of said elongate body, said channel having a closed upper end and an open lower end;

a top wall attached to an upper end of said at least one lateral wall; and one or more flexible brackets attached to one or more inner sides of said at least one lateral wall within said channel, each of said one or more flexible brackets having a vertically oriented aperture and also having a rearward facing opening, wherein said rearward facing opening of each of said one or more flexible brackets is capable of expanding or deforming to accept and be secured to a segment of a vertical fence post without the use of tools, said rearward facing opening of each of said one or more flexible brackets being naturally biased to converge to retain said vertical fence post.

8. The fence post cover of claim 7 wherein an indentation is formed on a bottom side of said top wall.

9. The fence post cover of claim 8 wherein said indentation is shaped to mate with a correspondingly shaped top end of a vertical fence post.

10. The fence post cover of claim 7 wherein said one or more flexible brackets are removably attached to said body.

11. The fence post cover of claim 7 wherein said first lateral wall and said second lateral wall have bottom portions configured to flex outwardly away from said channel.

12. The fence post cover of claim 7, further comprising a plurality of slots formed within said channel, each of said plurality of slots being sized and shaped to receive one of said one or more flexible brackets.

* * * * *